US011035375B1

(12) United States Patent
Hunt

(10) Patent No.: US 11,035,375 B1
(45) Date of Patent: Jun. 15, 2021

(54) PUMP DRIP CONTROL SYSTEM

(71) Applicant: Sundance Spas, Inc., Chino, CA (US)

(72) Inventor: Freddie E. Hunt, Rancho Cucamonga, CA (US)

(73) Assignee: Sundance Spas, Inc., Chino, CA (US)

( * ) Notice: Subject to any disclaimer, the term of this patent is extended or adjusted under 35 U.S.C. 154(b) by 177 days.

(21) Appl. No.: 16/451,747

(22) Filed: Jun. 25, 2019

Related U.S. Application Data

(60) Provisional application No. 62/690,039, filed on Jun. 26, 2018.

(51) Int. Cl.
*F04D 29/10* (2006.01)
*F04B 1/0443* (2020.01)

(52) U.S. Cl.
CPC ..... *F04D 29/106* (2013.01); *F04B 1/0443* (2013.01); *F05B 2230/60* (2013.01); *F05D 2260/6022* (2013.01)

(58) Field of Classification Search
CPC ... F04D 29/106; F05B 2230/60; F04B 1/0443
USPC ..... 415/168.1
See application file for complete search history.

(56) References Cited

U.S. PATENT DOCUMENTS 3,135,211 A * 6/1964 Pezzillo ..... F04D 13/0613 417/357
7,001,159 B2 * 2/2006 Peterson, Jr. ..... F04D 29/126 417/423.11
7,815,329 B2 10/2010 Scali et al.
7,824,161 B2 * 11/2010 Tandon ..... F04D 29/126 417/423.11
8,407,823 B2 4/2013 Sorensen et al.
8,789,216 B2 7/2014 Sorensen et al.
2009/0100589 A1 * 4/2009 Peterson, Jr. ..... F04D 29/106 4/509

* cited by examiner

*Primary Examiner* — J. Todd Newton
(74) *Attorney, Agent, or Firm* — The Webb Law Firm

(57) ABSTRACT

A pump drip control system for attachment to a pump assembly to prevent premature replacement of the pump. The control system includes a pump housing having a leakage collection chamber and a drip cap engaged with a second end of the leakage collection chamber. The drip cap includes a circumferential channel defining a flow path to a gathering chamber. The pump drip control system further includes a slinger assembly located within the leakage collection chamber, and wherein, in operation, the slinger assembly directs liquid leakage from the impeller shaft to the drip cap and the circumferential channel within the drip cap which directs the liquid along the circumferential flow path and into the gathering chamber. The gathering chamber can hold a predetermined amount of liquid until the liquid evaporates and includes a liquid exit port for draining excessive liquid out of the pump housing to another location.

20 Claims, 8 Drawing Sheets

PUMP DRIP CONTROL SYSTEM

CROSS REFERENCE TO RELATED APPLICATION

This application claims priority to provisional U.S. Application 62/690,039, filed Jun. 26, 2018, entitled "Pump Drip Control System", the disclosure of which is incorporated herein by reference in its entirety.

BACKGROUND OF THE INVENTION

Field of the Invention

The present disclosure is directed to spa pumps, and in particular, to pump drip control systems.

Description of Related Art

In spa pump systems, water leakage often occurs at the interface between the pump and the motor, in particular, where the pump impeller shaft and motor shaft mate outside a pump outlet housing. The pump is purposely designed to have a predetermined amount of leakage for lubrication purposes. This water then typically evaporates due to friction of the motor. However, on occasion, a small amount of this water leaks out of the pump housing. If water leakage is visible, repair personnel and spa owners believe there is a problem with the pump and will often replace these pumps prematurely, even though the motor is fully functional. This is a major problem in spa pump systems because usually, the leakage is small and does not require replacement of the pump. The vast majority of replaced pumps have relatively minor leaks and seal leakage is the predominate cause of spa pump return. For this reason, a pump drip control or collection system is needed to collect the leakage and allow it to evaporate or drain to an out of site location and thus, prevent premature replacement of the pump.

SUMMARY OF THE INVENTION

In accordance with an embodiment of the present disclosure, a pump drip control system for attachment to a pump assembly comprising a pump housing and an impeller shaft extending through a seal boss on the pump housing includes a leakage collection chamber located within the pump housing. The impeller shaft is associated with an impeller and the impeller shaft is sealingly engaged with the pump housing via a shaft seal. The impeller shaft is associated with a rotor shaft extending out of the pump housing and a motor for rotating the impeller. The leakage collection chamber has a first end and a second end and defines an interior volume. The first end is in sealing engagement with an outer surface of the seal boss. A portion of the impeller shaft is received within the interior volume of the leakage collection chamber. A drip cap is engaged with the second end of the leakage collection chamber. The drip cap includes a circumferential channel and a gathering chamber. The circumferential channel defines a circumferential flow path to the gathering chamber. The pump drip control system further includes a slinger assembly defining an aperture. The impeller shaft is received with the aperture of the slinger assembly and is in sealing engagement with the slinger assembly. The slinger assembly is positioned on the portion of the impeller shaft received within the leakage collection chamber, so that, in operation, the slinger assembly directs liquid leakage from the impeller shaft to the drip cap. The circumferential channel within the drip cap then directs the liquid along the circumferential flow path and into the gathering chamber. The gathering chamber can hold a predetermined amount of liquid until the liquid evaporates.

A liquid exit port can be associated with the gathering chamber. The liquid exit port can include an attachment portion associated therewith configured for attachment with one of a tube, hose, pipe, or other known device for draining excess liquid from the gathering chamber. This liquid can be drained to a pan located underneath the spa or within a wall portion of the spa and eventually drained therefrom.

The drip cap includes a central aperture configured to receive a rotor shaft extending from a pump motor. The gathering chamber of the drip cap is configured such that a majority of the volume of the gathering chamber is located below the central aperture such that the excess liquid can be evaporated or drained out of the gathering chamber to minimize leaking through the central aperture. The drip cap includes an annular gap between the central aperture and the rotor shaft so that excess liquid that exceeds a volume of the gathering chamber can exit the leakage collection chamber through the annular gap.

The drip cap includes a sidewall portion. According to one embodiment, this sidewall portion includes a housing seal configured for sealingly engaging the drip cap to the second end of the leakage collection chamber. According to another embodiment, the drip cap includes a sidewall portion defining an inner circumferential ledge configured to receive an O-ring wherein this O-ring is capable of sealingly engaging the second end of the leakage collection chamber.

According to one embodiment, the drip cap can include at least one stop to limit axial movement of the cap to a position that will maintain a seal of the cap with the housing.

In accordance with another embodiment of the present disclosure, a drip cap is provided for use with a leakage collection chamber located within a pump housing. The leakage collection chamber has a first end and a second end and defines an interior volume. The drip cap is configured for sealingly engaging the second end of the leakage collection chamber. The drip cap comprises an end wall and at least one sidewall, wherein at least one of the end wall and sidewall include a circumferential channel and a gathering chamber. The circumferential channel defines a circumferential flow path to the gathering chamber to direct liquid leakage from the leakage collection chamber to the circumferential channel within the drip cap and along the circumferential flow path and subsequently into the gathering chamber.

A liquid exit port is associated with the gathering chamber. This liquid exit port is configured for attachment with one of a tube, hose, pipe, or other known device for draining excess liquid from the gathering chamber. An attachment member, associated with the liquid exit portion, can extend from an outer surface of the cap for attachment to the tube, hose, pipe, or other known device. The tube, hose, pipe, or other known device can drain the water to a location that is underneath the spa or tub and through an exit drain for the spa.

According to one embodiment, the sidewall of the cap includes a housing seal configured to sealingly engage the second end of the leakage collection chamber. According to another embodiment, the sidewall of the cap includes a portion that defines an inner circumferential ledge configured to receive an O-ring wherein the O-ring is capable of sealingly engaging the second end of the leakage collection chamber.

The drip cap can include at least one stop to limit axial movement of the cap to a position that will maintain a seal of the cap with the housing.

In accordance with another embodiment of the present disclosure, a method for reducing leakage from a pump housing including an impeller shaft extending through a seal boss on the pump housing comprises providing a leakage collection chamber within the pump housing. The leakage collection chamber has a first end and a second end and defines an interior volume, wherein the first end is in sealing engagement with an outer surface of the seal boss, and a portion of the impeller shaft is received within the interior volume. The method further comprises providing a drip cap, wherein the drip cap includes a circumferential channel and a gathering chamber, and wherein the circumferential channel defines a circumferential flow path to the gathering chamber. The method further includes sealingly engaging the drip cap with the second end of the leakage collection chamber and mounting a slinger assembly on the impeller shaft, wherein the slinger assembly is positioned on the portion of the impeller shaft received within the leakage collection chamber and wherein, in operation, the slinger assembly directs liquid leakage from the impeller shaft to the drip cap and the circumferential channel within the drip cap which directs the liquid along the circumferential flow path and subsequently into the gathering chamber.

The drip cap can include a liquid exit port associated with the gathering chamber and the method includes attaching one of a tube, hose, pipe, or other known device with the exit port to drain excess liquid from the gathering chamber. A separate attachment member can be provided for securing the tube, hose, pipe, or other known device with the liquid exit port.

The drip cap includes a central aperture and the method includes mounting the drip cap on a rotor shaft extending from a pump motor. The drip cap is mounted on the rotor shaft and engaged with the leakage collection chamber in an orientation wherein a majority of the volume of the gathering chamber is located below the central aperture such that the excess liquid can be evaporated or drained out of the gathering chamber to minimize leaking through the central aperture. The drip cap includes an annular gap between the central aperture and the rotor shaft so that excess liquid that exceeds a volume of the gathering chamber exits the leakage collection chamber through the annular gap.

According to one embodiment, the drip cap includes a sidewall portion and the method includes associating a housing seal with the sidewall portion. According to another embodiment, the sidewall of the drip cap includes an inner circumferential ledge and the method includes positioning an O-ring adjacent to this ledge. Upon placement of the drip cap on the second end of the leakage collection chamber, the housing seal or the O-ring sealingly engages the second end of the leakage collection chamber.

DESCRIPTION OF THE INVENTION

Figure 1:
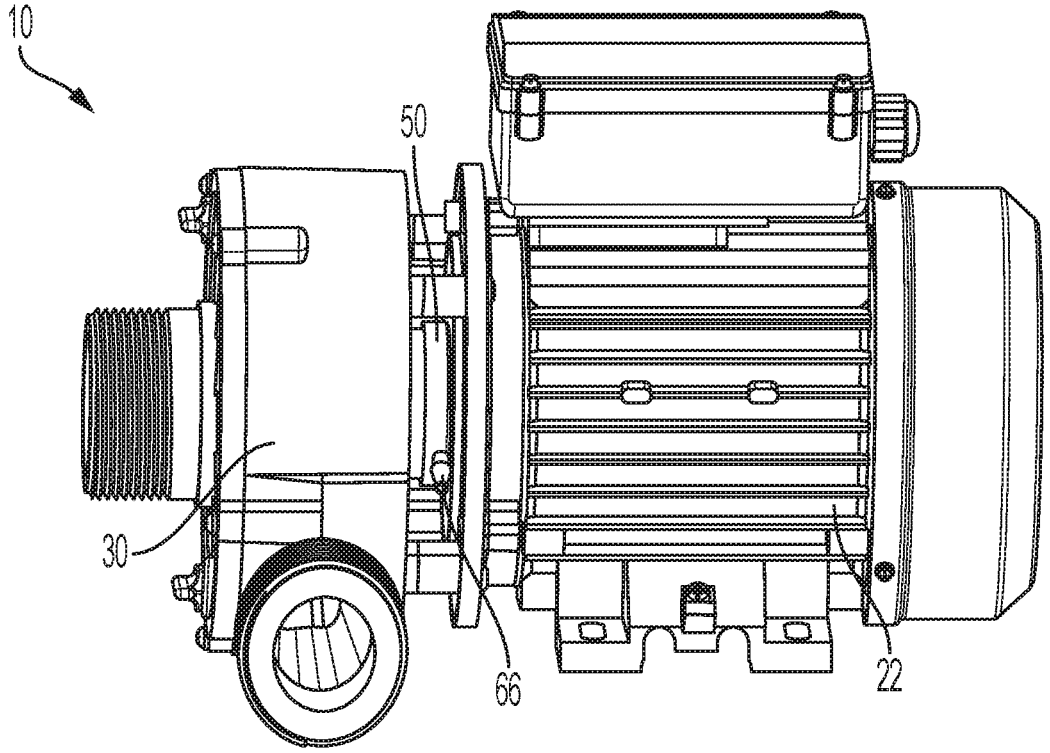
FIG. 1 is a side perspective view of a spa pump assembly including a drip cap in accordance with an embodiment of the present disclosure.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting.

Figure 2:
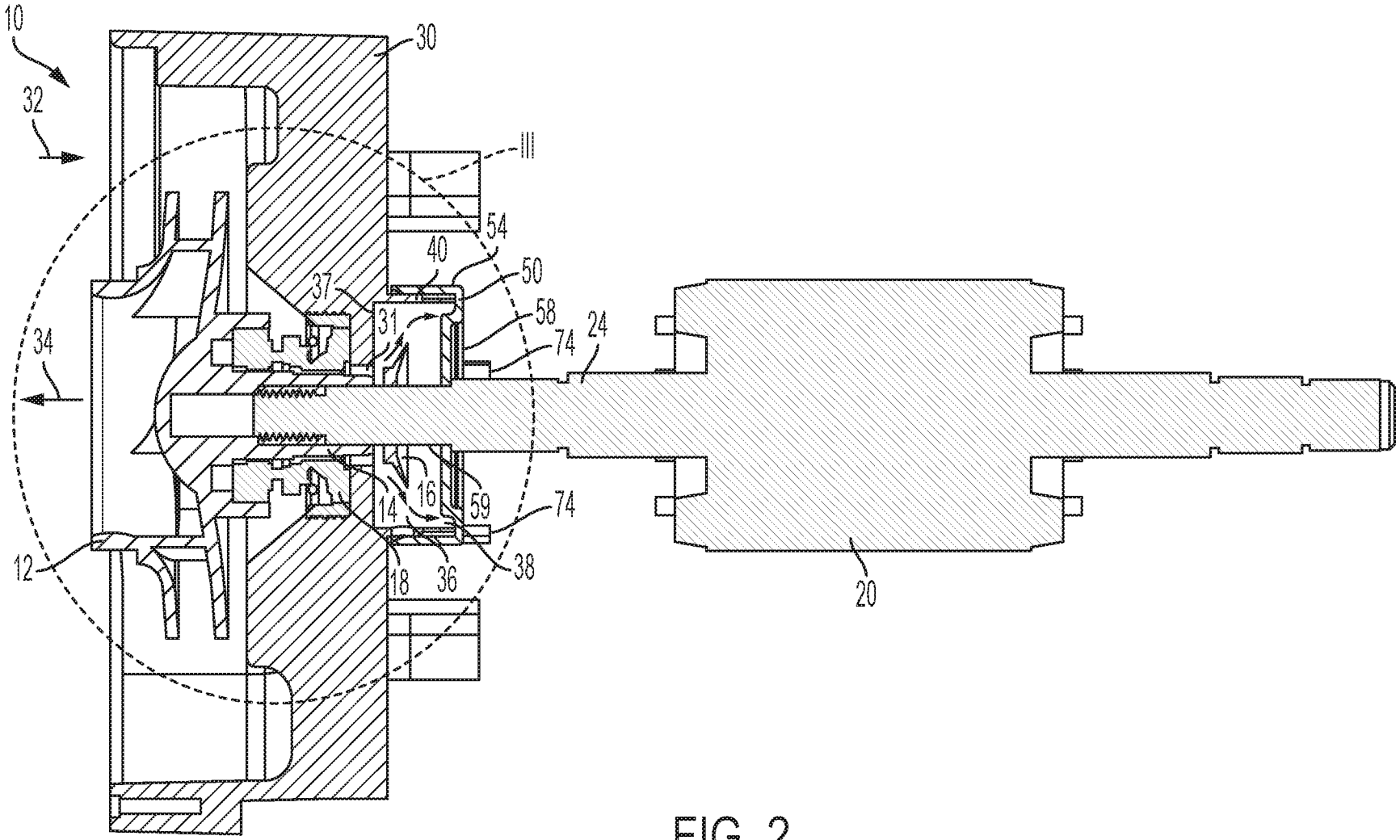
FIG. 2 is a cross-section view of the spa pump assembly of FIG. 1, with the housing of the spa motor omitted, in accordance with an embodiment of the present disclosure.
Figure 3:
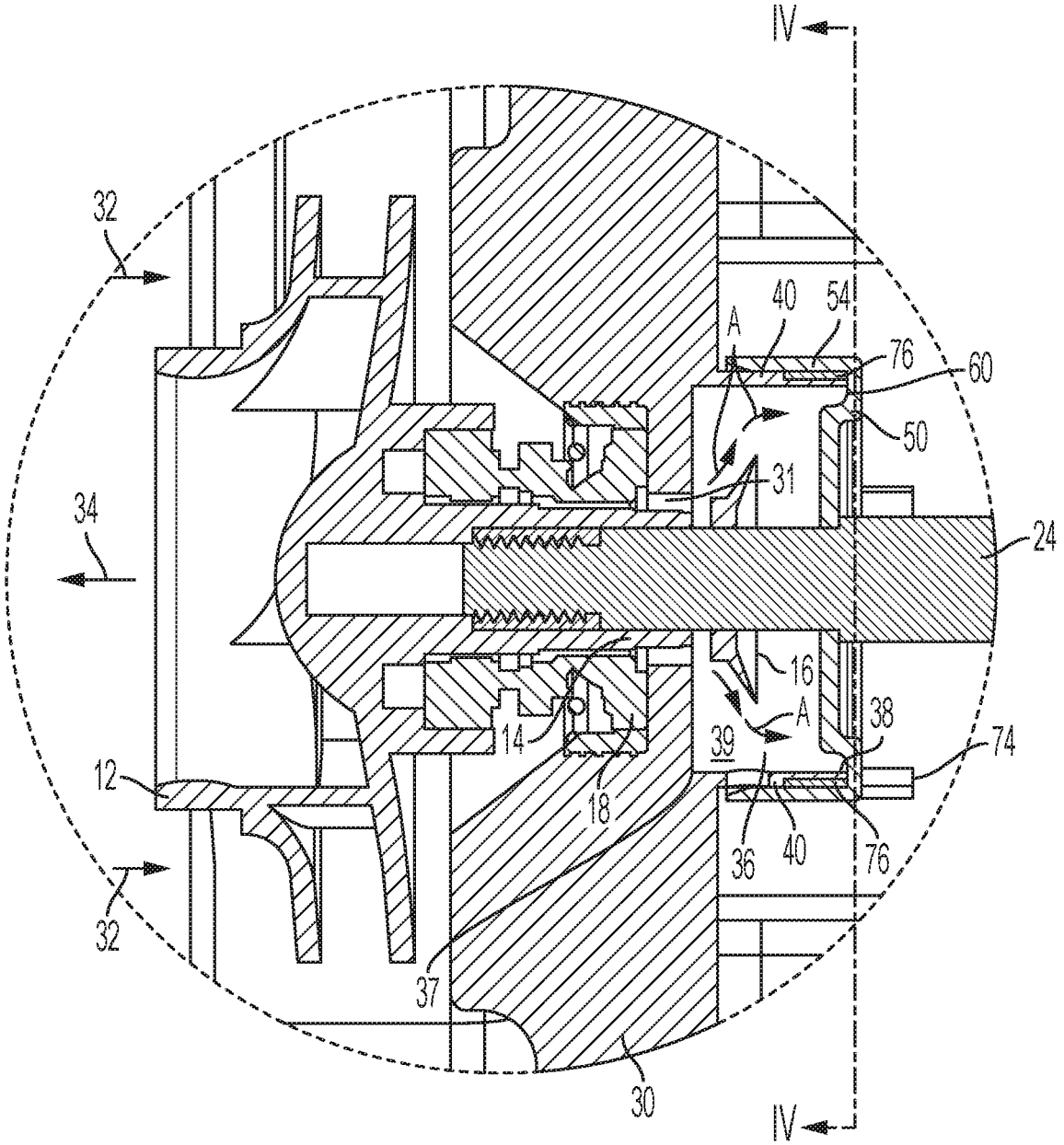
FIG. 3 is an exploded view of the pump housing as indicated by section III in FIG. 2, in accordance with an embodiment of the present disclosure.

Reference is now made to FIGS. 1-3 which show a spa pump assembly, generally indicated as 10, including a pump drip control system, for use with a spa (not shown). The spa pump assembly includes an impeller 12 having an impeller shaft 14. A pump motor 20 (FIG. 3), enclosed within a motor housing 22 (FIG. 1), includes a rotor shaft 24 that extends out of the motor housing 22 and is received within the impeller shaft 14. The pump motor 20 applies a rotational force to the impeller 12. A slinger assembly 16 includes a central aperture that is mounted on the rotor shaft 24. The impeller 12 and impeller shaft 14, along with the slinger assembly 16 are enclosed within a pump housing 30. The impeller shaft 14 extends through a seal boss 31 on the pump housing 30. A shaft seal 18 is provided that sealingly engages the impeller shaft 14 to the pump housing 30. The pump housing 30 includes a water inlet portion 32 for drawing water therein via vacuum pressure and the water then exits the pump housing 30 through a water outlet portion 34 in an agitated form via the impeller 12. The pump housing 30 includes a leakage collection chamber 36 for collecting water. The slinger assembly 16 can be located within this leakage collection chamber 36 to sling any water as shown by the arrows in FIG. 3 that leaks through shaft seal 18 into the leakage collection chamber 36. The leakage collection chamber 36 has a first end 37 and a second end 38 and defines an interior volume 39. The first end 37 is in sealing engagement with an outer surface of the seal boss 31 and a portion of the impeller shaft 14 is received within the interior volume 39 of the leakage collection chamber 36.

With continuing reference to FIGS. 1-3 and with further reference to FIGS. 4, 5A-5B, and 6A-6B, a drip cap 50 cooperates with the second end 38 of the leakage collection chamber 36, to trap any excess liquid or water that escapes through the shaft seal 18 and into the interior volume 39. The leakage collection chamber 36 and second end 38 is defined by at least one sidewall 40. The liquid or water is held within the interior volume 39 of the leakage collection chamber 36, out of site from the spa owner and/or repair personnel, until it evaporates and/or is drained away. The drip cap 50 includes a circumferential channel 60 forming a circumferential flow path that empties into a gathering chamber 62. The slinger assembly 16 is positioned on the portion of the impeller shaft 14 received within the leakage collection chamber 36 such that, in operation, the slinger assembly 16 directs liquid leakage from the impeller shaft 14 to the drip cap 50 and the circumferential channel 60 within the drip cap 50 which directs the liquid or water along the circumferential flow path and into the gathering chamber 62. The gathering chamber 62 can hold a predetermined amount of liquid until the liquid evaporates.

A liquid exit port 64 can be associated with the gathering chamber 62. The liquid exit port 64 can include an attachment portion 66 associated therewith configured for attachment with one of a tube, hose, pipe, or other known device capable of draining excess liquid from the gathering chamber 62. This liquid can be drained to a pan (not shown) located underneath the spa or within a wall portion of the spa and eventually drained therefrom. Alternatively, the liquid can be drained to the same drain used to empty the contents of the spa.

The drip cap 50 includes the central aperture 58 configured to receive the rotor shaft 24 extending from the pump motor 20. The gathering chamber 62 is configured such that when the drip cap 50 is mounted on the rotor shaft 24, a majority of the volume of the gathering chamber 62 is located below the central aperture 58 so that the excess liquid gathers in the gathering chamber 62 and can be evaporated or drained out of the gathering chamber 62 to minimize leaking through the central aperture 58. The drip cap 50 includes an annular gap 59 between the central aperture 58 and the rotor shaft 24 and wherein excess liquid that exceeds a volume of the gathering chamber 62 can exit the leakage collection chamber 36 through the annular gap 59.

With continuing reference to FIGS. 1-3 and with reference to FIGS. 4, 5, 5A-5B, 6, and 6A-6B, the drip cap 50 comprises a cup-shaped member having an end wall 52 and at least one sidewall portion 54 defining an open portion 56. The drip cap 50 includes the central aperture 58 adapted to fit on the rotor shaft 24. The sidewall portion 54 fits about sidewall 40 of the pump housing 30 to close the second end 38 of the leakage collection chamber 36. The drip cap 50 includes a circumferential channel 60 and a gathering chamber 62 wherein the circumferential channel 60 defines a circumferential flow path to the gathering chamber 62.

Figure 4:
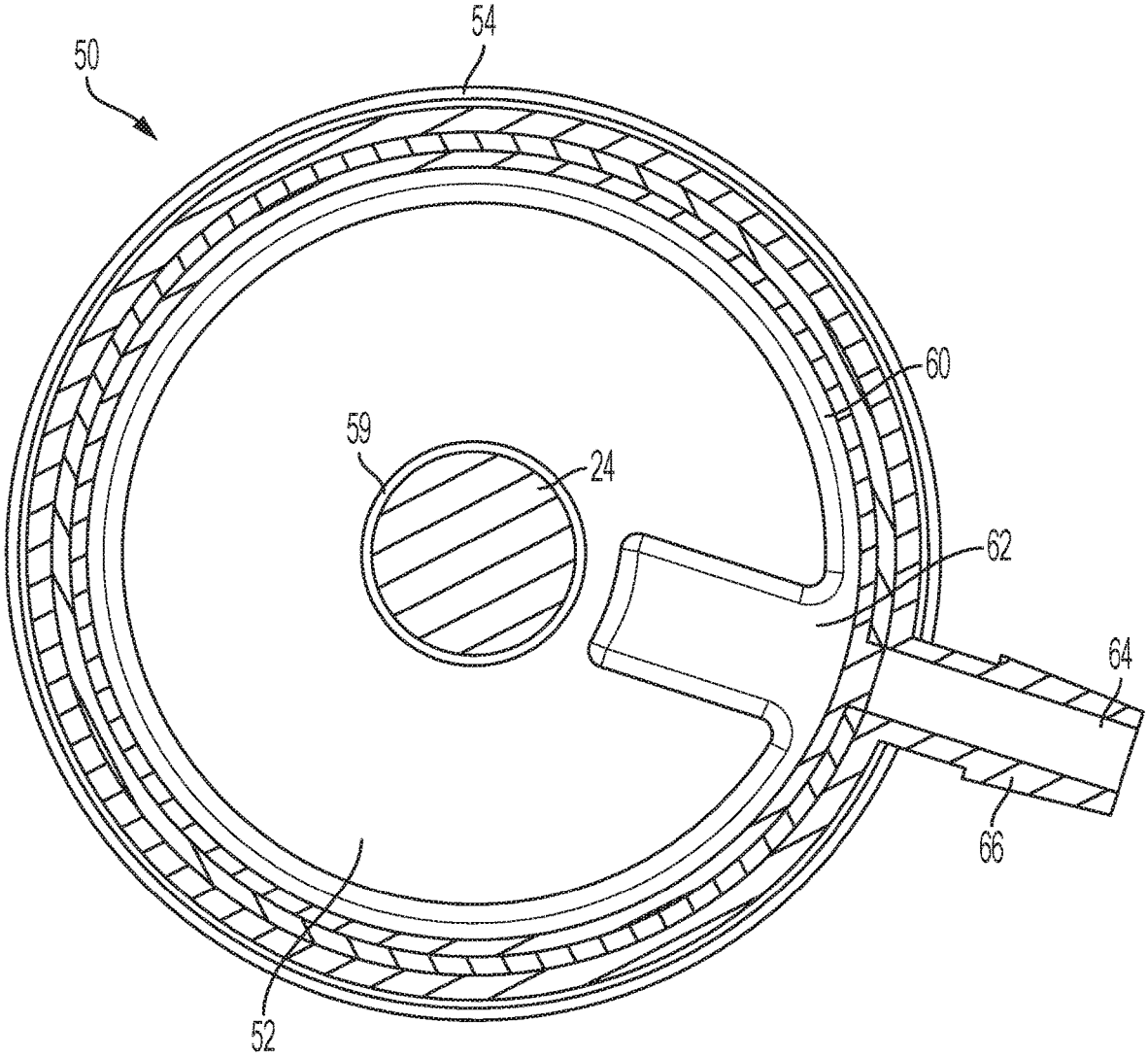
FIG. 4 is a cross-sectional view of the drip cap taken along line IV-IV of FIG. 3 in accordance with an embodiment of the present disclosure.

The sidewall portion 54, as shown in FIGS. 2-4, (54A in FIGS. 5A and 54B in FIG. 6A) of the drip cap 50 can be secured to the sidewall 40 of the leakage collection chamber 36 by a friction fit, latches, detents, and any other well known securing technique. It can be appreciated that the drip cap 50 can be secured by a technique that allows the cap to be removed from the pump housing 30 and the leakage collection chamber 36, so as to facilitate repairs within the pump housing or replacement of the drip cap 50. Alternatively, the drip cap 50 can be permanently secured to the pump housing via adhesive or integrally joined to the pump housing 30 during manufacture. It is noted that FIGS. 2 and 3 show the sidewall portion 54 of the drip cap 50 encompassing the sidewall 40 of the leakage collection chamber 36 of the pump housing 30, however, it can appreciated that the arrangement of the sidewalls can be reversed such that the sidewall 40 of the leakage collection chamber 36 of the pump housing 30 encompasses the sidewall portion 54 of the drip cap 50. It is also noted that the figures show the drip cap 50 as having a circular shape and the second end 38 of the leakage collection chamber 36 also having a circular shape, however, it can further be appreciated that the drip cap 50 and second end 38 can have other shapes as long as these shapes correspond with each other so that the drip cap 50 cooperates with the second end 38 to define the interior volume 39 of the leakage collection chamber 36.

Figure 5:
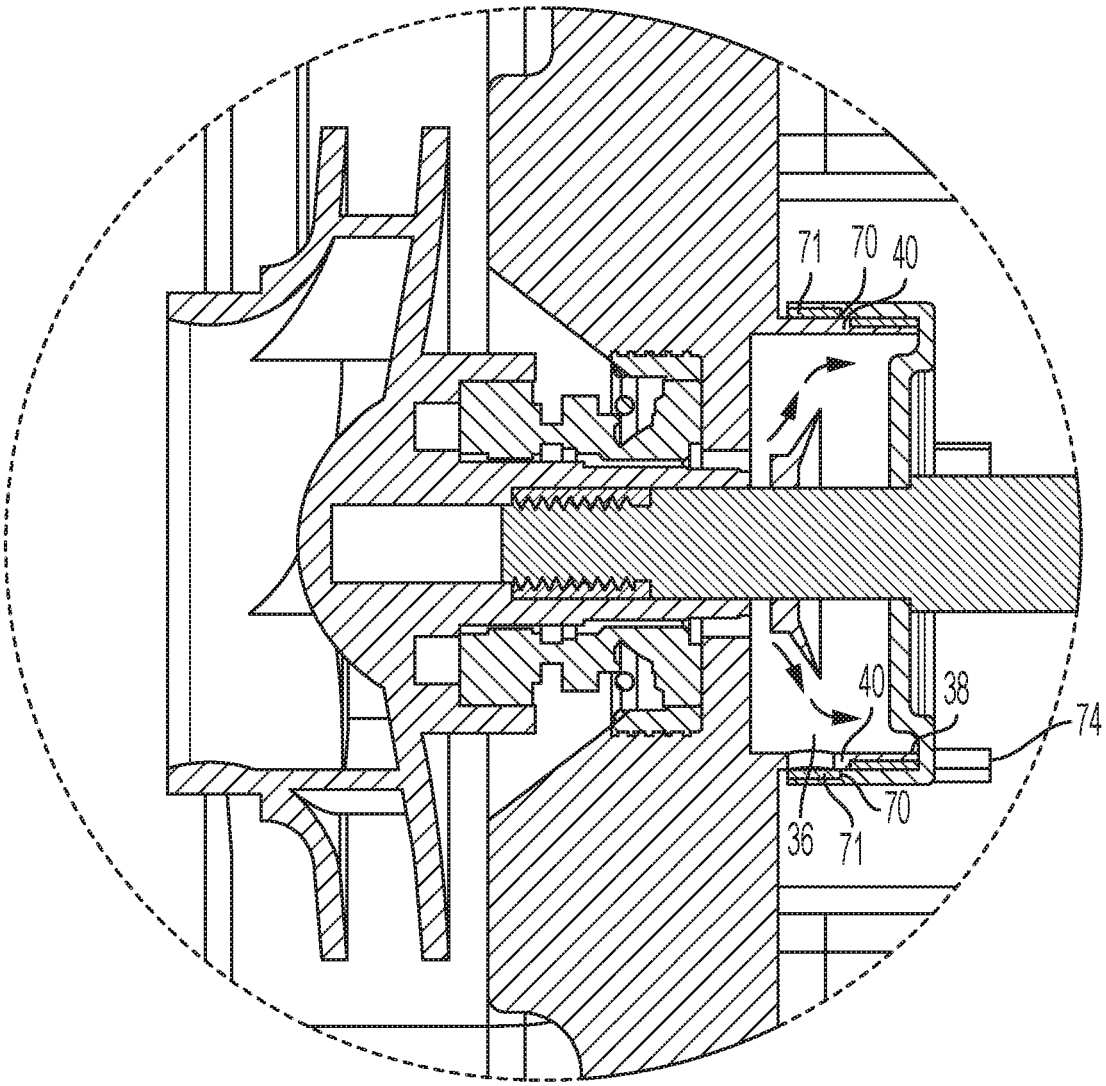
FIG. 5 is a cross-sectional view of a drip cap mounted on the pump housing in accordance with an embodiment of the present disclosure.
Figure 5A:
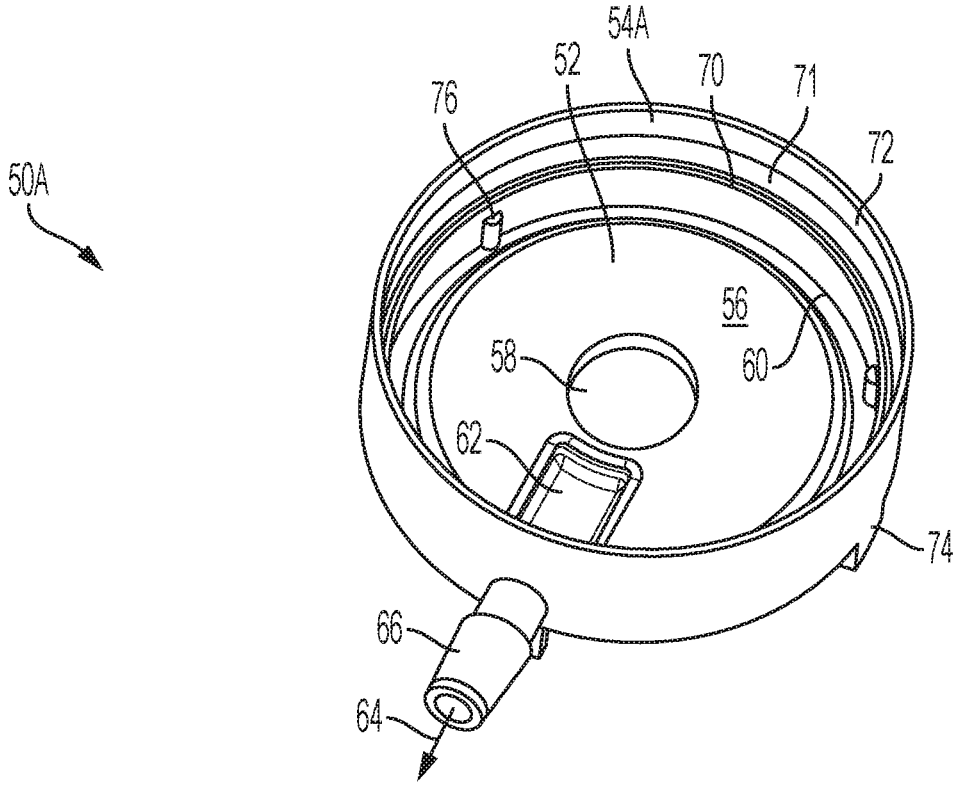
FIG. 5A is a top perspective view of the drip cap of FIG. 5 in accordance with an embodiment of the present disclosure.
Figure 5B:
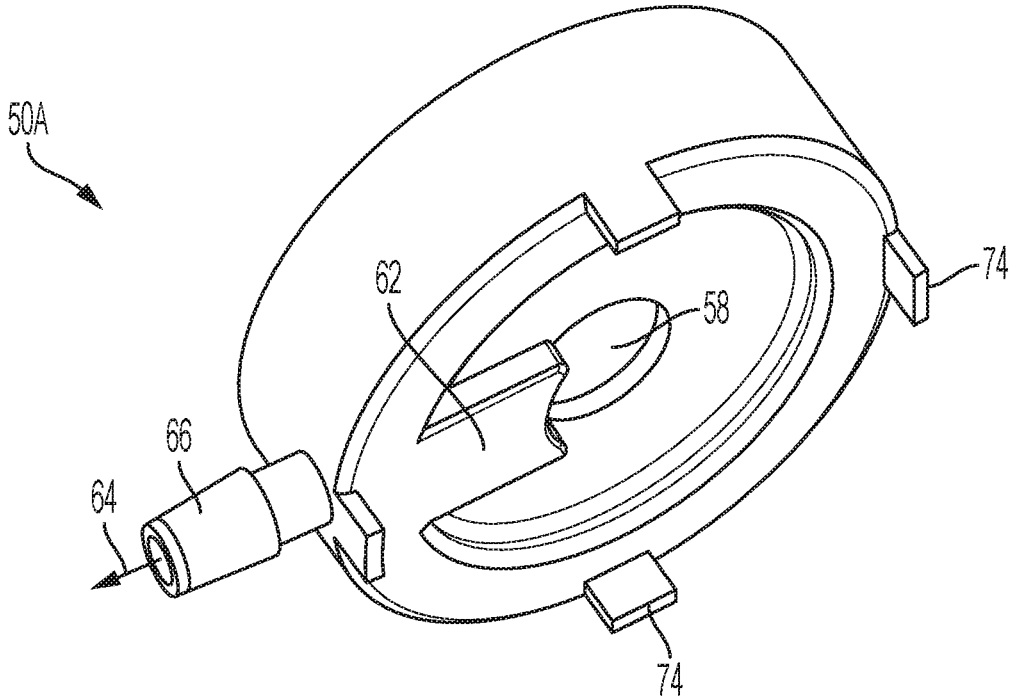
FIG. 5B is a bottom perspective view of the drip cap of FIG. 5 in accordance with an embodiment of the present disclosure.

According to one embodiment, as shown in FIGS. 5, 5A, and 5B, the drip cap, generally indicated as 50A, includes a sidewall portion 54A defining an inner circumferential ledge 70 configured to receive a sealing medium 71, such as an O-ring, wherein this O-ring is capable of sealingly engaging the second end 38 of the leakage collection chamber 36. It can be appreciated that other sealing mediums can be used such as a flowable sealant (i.e., silicone), grease, and the like. These sealing mediums can be used separately or in combination with each other. In this embodiment, the drip cap 50A includes an inner diameter that forms the outer wall 72 of the O-ring groove and the inner circumferential ledge 70 forms the bottom wall of the O-ring groove. When the drip cap 50A is mounted onto the second end 38 of the leakage collection chamber 36 of the pump housing 30, an outer diameter of the sidewall 40 of the second end 38 becomes the inner wall of the O-ring groove. The seal 71 is a radial compression seal with axial movement stopped by the inner circumferential ledge 70. According to one embodiment, the drip cap 50A can include one or more externally disposed standoffs 74 to ensure that the drip cap 50A is always pushed onto the second end 38 of the leakage collection chamber 36 to achieve a good O-ring seal. In other words, ends of the standoffs 74 abut against the motor housing so that the drip cap 50A is maintained in a sealed position on the second end 38 of the leakage collection chamber 36. The drip cap 50A can include at least one internally disposed stop 76 to limit axial movement of the drip cap 50A to a position that will maintain a seal of the drip cap 50A with the second end 38 of the leakage collection chamber 36. According to one embodiment, the at least one stop 76 can include a plurality of stops extending from the end wall 52 into the open portion 56 of the drip cap 50A. The stops 76 abut against the sidewall 40 of the pump housing 30. The stops 76 have a predetermined height to ensure that a distance from the second end 38 of the leakage collection chamber 36 is always the same, resulting in relatively consistent seal loading.

Figure 6:
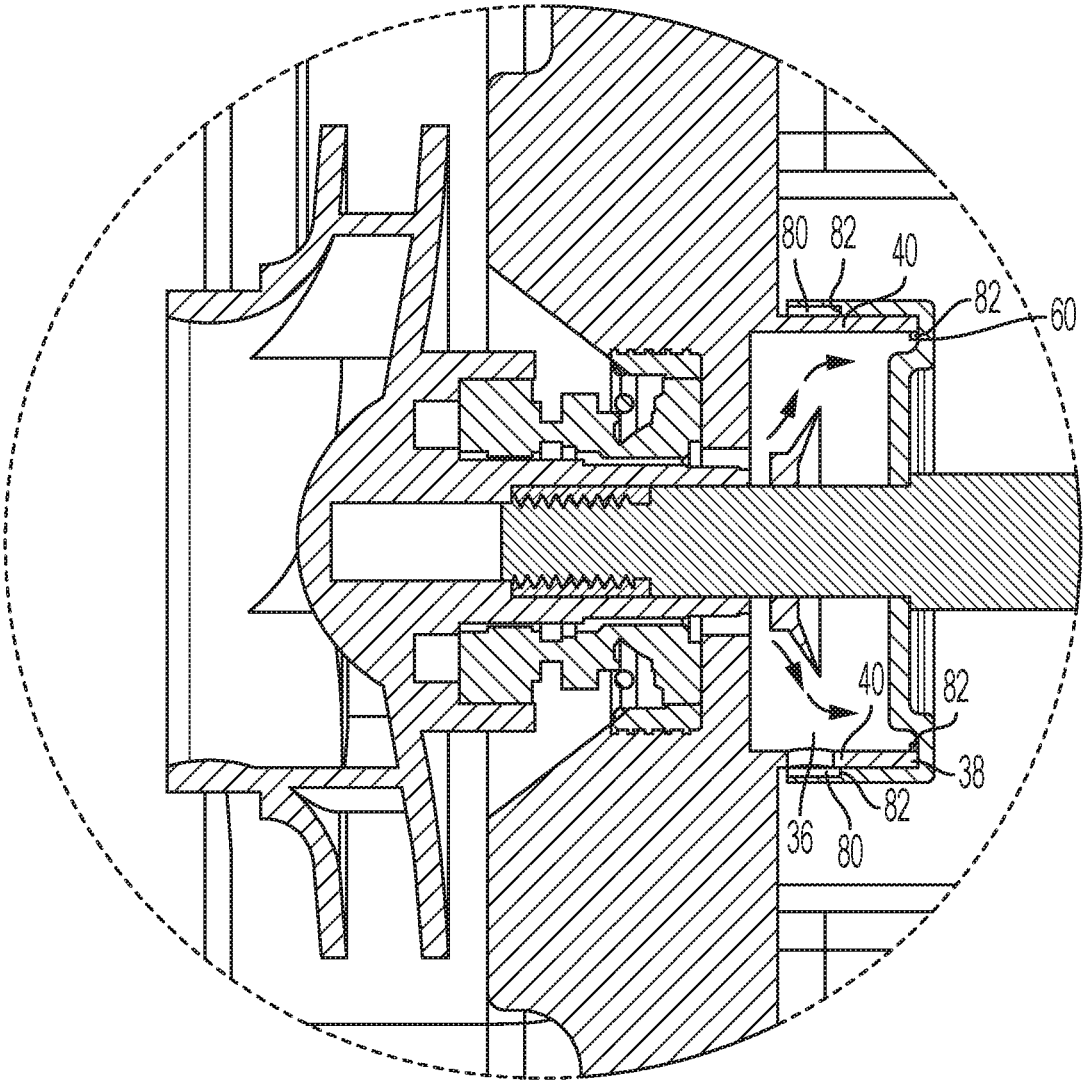
FIG. 6 is a cross-sectional view of a drip cap mounted on the pump housing in accordance with an embodiment of the present disclosure.
Figure 6A:
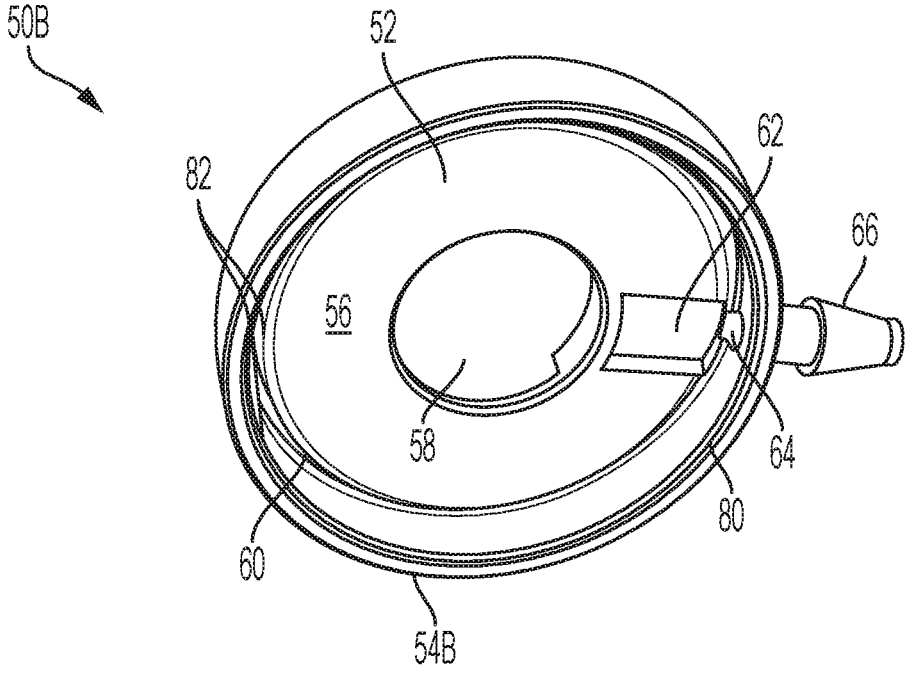
FIG. 6A is a top perspective view of the drip cap of FIG. 6 in accordance with another embodiment of the present disclosure.
Figure 6B:
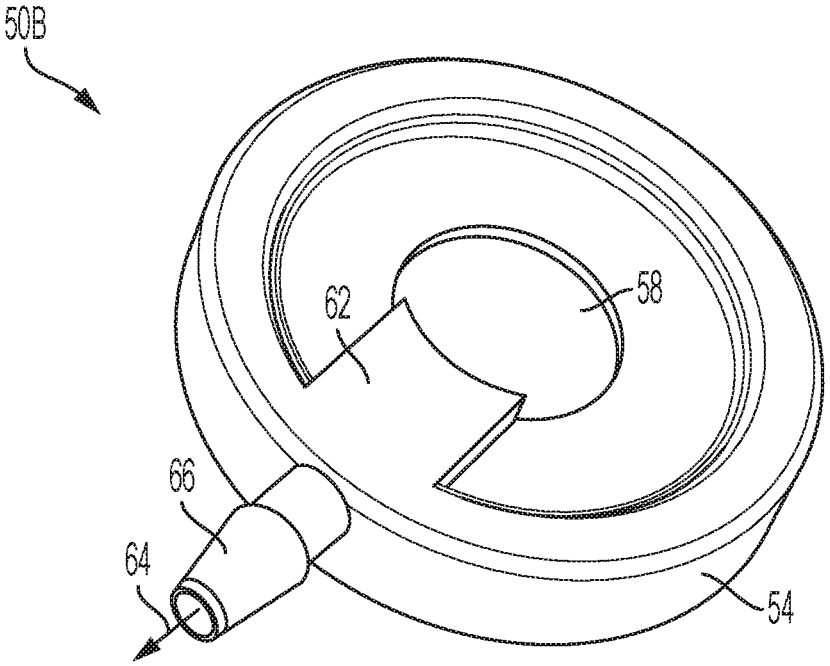
FIG. 6B is a bottom perspective view of the drip cap of FIG. 6A in accordance with an embodiment of the present disclosure.

According to another embodiment, as shown in FIGS. 6, 6A, and 6B, the drip cap, generally indicated as 50B, can have a sidewall portion 54B that includes a housing seal 80 configured for sealingly engaging the drip cap 50B to the second end 38 of the leakage collection chamber 36. The housing seal 80 can be in the form of an interference fit bead that radially presses against an outer surface of the sidewall 40 of the second end 38 of the leakage collection chamber 36. Positioning members 82, are such as in the form of circumferential stops, assist with the positioning of the drip cap 50B on the second end 38 of the leakage collection chamber 36. In this configuration, the friction of the housing seal 80 in the form of the interference fit bead keeps the drip cap 50B in place. The drip cap 50B is pushed onto the second end 38 of the leakage collection chamber 36 until the second end 38 bottoms out on outer sidewalls of the circumferential channel 60. This design still maintains access to the circumferential channel 60. Thus, any leakage is thrown out radially in any direction and will end up along the circumferential channel 60 and flow along the gravitation flow path created from the channel 60 to the gathering chamber 62 located at a bottom portion of the circumferential channel 60.

As discussed above and shown in FIGS. 5A-5B and 6A-6B, any liquid collected within the gathering chamber 62, can be held therein until evaporated or, if the volume of the collected liquid exceeds a predetermined volume of the gathering chamber 62, the liquid excess can be drained via liquid exit port 64. This fluid exit port 64 can be in fluid communication with an attachment portion 66, which can form a sealed connection to a tube, hose, pipe, or any other known device which drains the excess liquid away from the spa pump assembly 10. The leakage control system of the present invention reduces the visibility of typical and/or intentional water leakage, which, in turn reduces the premature replacement of pumps.

While the present disclosure is satisfied by embodiments in many different forms, there is shown in the drawings, and described herein in detail, the preferred embodiments of the disclosure, with the understanding that the present disclosure is to be considered as exemplary of the principles of the disclosure and is not intended to limit the disclosure to the embodiments illustrated. Various other embodiments will be apparent to and readily made by those skilled in the art without departing from the scope and spirit of the disclosure. The scope of the disclosure will be measured by the appended claims and their equivalents.

The invention claimed is:

1. A pump drip control system for attachment to a pump assembly comprising a pump housing and an impeller shaft extending through a seal boss on the pump housing, said pump drip control system comprising:

a leakage collection chamber located within the pump housing, the leakage collection chamber having a first end and a second end and defining an interior volume, wherein the first end is in sealing engagement with an outer surface of the seal boss, and a portion of the impeller shaft is received within the interior volume;

a drip cap engaged with the second end of the leakage collection chamber, said drip cap including a circumferential channel and a gathering chamber wherein the circumferential channel defines a circumferential flow path to the gathering chamber; and a slinger assembly defining an aperture, the impeller shaft being received within the aperture in sealing engagement with the slinger assembly, wherein the slinger assembly is positioned on the portion of the impeller shaft received within the leakage collection chamber, wherein, in operation, the slinger assembly directs liquid leakage from the impeller shaft to the drip cap and the circumferential channel within the drip cap which directs the liquid along the circumferential flow path and into the gathering chamber.

2. The pump drip control system of claim 1, wherein the drip cap includes a liquid exit port associated with the gathering chamber, said liquid exit port configured for attachment with one of a tube, hose, or pipe for draining excess liquid from the gathering chamber.

3. The pump drip control system of claim 1, wherein the drip cap includes a central aperture configured to receive a rotor shaft extending from a pump motor.

4. The pump drip control system of claim 3, wherein the gathering chamber of the drip cap is configured such that a majority of the volume of the gathering chamber is located below the central aperture such that at least some of the liquid can be evaporated or drained out of the gathering chamber to minimize leaking through the central aperture.

5. The pump drip control system of claim 4, wherein the drip cap includes an annular gap between the central aperture and the rotor shaft and wherein an amount of liquid that exceeds a volume of the gathering chamber can exit the leakage collection chamber through the annular gap.

6. The pump drip control system of claim 1, wherein the drip cap includes a sidewall portion having a housing seal configured to sealingly engage the second end of the leakage collection chamber.

7. The pump drip control system of claim 1, wherein the drip cap includes a sidewall portion defining an inner circumferential ledge configured to receive an O-ring wherein the O-ring is capable of sealingly engaging the second end of the leakage collection chamber.

8. The pump drip control system of claim 1, wherein the drip cap includes at least one stop to limit axial movement of the drip cap to a position that will maintain a seal of the drip cap with the leakage collection chamber.

9. The pump drip control system of claim 1, wherein the impeller shaft is associated with an impeller and the impeller shaft is sealingly engaged with the pump housing via a shaft seal, the impeller shaft being associated with a rotor shaft extending out of the pump housing and a motor for rotating the impeller.

10. A drip cap for use with a leakage collection chamber located within a pump housing, the leakage collection chamber having a first end and a second end and defining an interior volume, the drip cap configured for sealingly engaging the second end of the leakage collection chamber, said drip cap comprising an end wall and at least one sidewall, wherein at least one of the end wall and sidewall include a circumferential channel and a gathering chamber, wherein the circumferential channel defines a circumferential flow path to the gathering chamber to direct liquid leakage from the leakage collection chamber to the circumferential channel within the drip cap and along the circumferential flow path and into the gathering chamber.

11. The drip cap of claim 10 including a liquid exit port associated with the gathering chamber, said liquid exit port configured for attachment with one of a tube, hose, or pipe for draining excess liquid from the gathering chamber.

12. The drip cap of claim 10, wherein the sidewall includes a housing seal configured to sealingly engage the second end of the leakage collection chamber.

13. The drip cap of claim 11, wherein the sidewall includes a portion that defines an inner circumferential ledge configured to receive an O-ring wherein the O-ring is capable of sealingly engaging the second end of the leakage collection chamber.

14. The drip cap of claim 11, including at least one stop to limit axial movement of the cap to a position that will maintain a seal of the cap with the housing.

15. A method for reducing leakage from a pump housing including an impeller shaft extending through a seal boss on the pump housing, said method comprising:

providing a leakage collection chamber within the pump housing, the leakage collection chamber having a first end and a second end and defining an interior volume, wherein the first end is in sealing engagement with an outer surface of the seal boss, and a portion of the impeller shaft is received within the interior volume;

providing a drip cap, said drip cap including a circumferential channel and a gathering chamber wherein the circumferential channel defines a circumferential flow path to the gathering chamber;

sealingly engaging the drip cap with the second end of the leakage collection chamber; and mounting a slinger assembly on the impeller shaft, wherein the slinger assembly is positioned on the portion of the impeller shaft received within the leakage collection chamber, wherein, in operation, the slinger assembly directs liquid leakage from the impeller shaft to the drip cap and the circumferential channel within the drip cap which directs the liquid along the circumferential flow path and into the gathering chamber.

16. The method of claim 15, wherein the drip cap includes a liquid exit port associated with the gathering chamber and the method includes attaching one of a tube, hose, or pipe with the exit port to drain excess liquid from the gathering chamber.

17. The method of claim 15, wherein the drip cap includes a central aperture and the method including mounting the drip cap on a rotor shaft extending from a pump motor.

18. The method of claim 17, wherein the drip cap is mounted on the rotor shaft and the leakage collection chamber such that a majority of the volume of the gathering chamber is located below the central aperture such that the excess liquid can be evaporated or drained out of the gathering chamber to minimize leaking through the central aperture.

19. The method of claim 18, wherein the drip cap includes an annular gap between the central aperture and the rotor shaft and wherein excess liquid that exceeds a volume of the gathering chamber exits the leakage collection chamber through the annular gap.

20. The method of claim 15, wherein the drip cap includes a sidewall portion and wherein the method includes associating a housing seal with the sidewall or providing an inner circumferential ledge within the sidewall portion configured to receive an O-ring and wherein the housing seal or O-ring is configured to sealingly engage the second end of the leakage collection chamber.

* * * * *